US009936848B2

(12) United States Patent
Brain et al.

(10) Patent No.: US 9,936,848 B2
(45) Date of Patent: Apr. 10, 2018

(54) FLOOR CLEANING APPARATUS AND TOUCHLESS, RECYCLING MOPPING SYSTEM

(71) Applicant: Puressence Ventures, Inc., Miami Beach, FL (US)

(72) Inventors: Terry Brain, East Garafraxa (CA); Nikoleta Angelova, Miami Beach, FL (US)

(73) Assignee: PURESSENCE VENTURES, INC., Miami, FL (US)

( * ) Notice: Subject to any disclaimer, the term of this patent is extended or adjusted under 35 U.S.C. 154(b) by 449 days.

(21) Appl. No.: 14/588,141

(22) Filed: Dec. 31, 2014

(65) Prior Publication Data

US 2015/0182094 A1 Jul. 2, 2015

Related U.S. Application Data

(60) Provisional application No. 61/922,243, filed on Dec. 31, 2013.

(51) Int. Cl.

| | |
|---|---|
| ***A47L 13/20*** | (2006.01) |
| ***A47L 13/42*** | (2006.01) |
| ***A47L 13/59*** | (2006.01) |
| ***A47L 13/254*** | (2006.01) |

(52) U.S. Cl.

CPC ..... *A47L 13/42* (2013.01); *A47L 13/254* (2013.01); *A47L 13/59* (2013.01)

(58) Field of Classification Search

CPC ..... A47L 13/42; A47L 13/254; A47L 13/59; A47L 13/58; A47L 13/60

See application file for complete search history.

(56) References Cited

U.S. PATENT DOCUMENTS

| | | | |
|---|---|---|---|
| 3,630,369 | A | 12/1971 | Nichols |
| 3,955,528 | A | 5/1976 | Bounds et al. |
| 4,798,307 | A | 1/1989 | Evrard |
| 4,886,081 | A | 12/1989 | Blaul |
| 5,004,535 | A | 4/1991 | Bosko et al. |

(Continued)

FOREIGN PATENT DOCUMENTS

| | | |
|---|---|---|
| GB | 1520839 | 8/1978 |
| GB | 2323776 A | 7/1998 |
| WO | WO 2004/105570 A1 | 9/2004 |

*Primary Examiner* — Shay Karls

(74) *Attorney, Agent, or Firm* — Carrie M. Stroup

(57) ABSTRACT

A user touchless mopping system comprising: a rinse tank with a top receptacle for receiving a mop cleaning head; a holding tank; a cleaning mechanism in fluid communication with the rinse tank and the holding tank; a sensor in communication with the mop cleaning head, and configured for determining that it has been received in a rinse tank receptacle; and, a control module configured to direct the cleaning mechanism to clean the mop head when it is placed into holding tank receptacle and detected by the sensors. The holding tank comprises an automated water filtering system configured to provide clean and disinfected water to the mop head; and, the rinse tank comprises an automated touch-less mop head rinsing, wringing mechanism. The system can include suctioning of contaminated water out of the rinse tank, through the holding tank filtering and disinfectant system to recycle the water for later usage.

21 Claims, 18 Drawing Sheets

(56) References Cited

U.S. PATENT DOCUMENTS

| | | | | |
|---|---|---|---|---|
| 6,464,884 | B1 | 10/2002 | Gadgil | |
| 6,523,220 | B1 | 2/2003 | Lynn | |
| 7,900,314 | B2 * | 3/2011 | Damrath | A47L 13/60 15/260 |
| 2005/0076465 | A1 | 4/2005 | Rousey | |
| 2005/0132519 | A1 | 6/2005 | Chen et al. | |
| 2010/0095473 | A1 | 4/2010 | Azancot | |
| 2011/0203613 | A1 | 8/2011 | Roberts | |
| 2012/0241389 | A1 | 9/2012 | Van Landingham et al. | |

* cited by examiner

FLOOR CLEANING APPARATUS AND TOUCHLESS, RECYCLING MOPPING SYSTEM

CROSS-REFERENCE TO RELATED APPLICATIONS

This application claims benefit and priority of U.S. Provisional Patent Application Ser. No. 61/922,243, filed Dec. 31, 2013, the disclosure of which is hereby incorporated by reference in its entirety.

FIELD OF THE INVENTION

Disclosed embodiments generally relate to mopping systems for cleaning solid surfaces such as floors.

BACKGROUND

There are two primary types of floor cleaning systems: vacuums and mops. Vacuums primarily utilize suction to pull dust and dirt from carpets and floors, while mops have historically comprised wet sponges, or the like, for applying liquids to wipe a floor clean. Conventional mop and bucket systems are not reliable in removing all dirt from a floor due to the tendency of the mop head, be it a sponge or fabric type, to permanently embed dirt and bacteria into the fibers of the mop head that are then re-deposited onto the floor. Every time the user dumps the mop head into the bucket, they are transferring dirt and bacteria from the floor to the water in the bucket, which is then distributed to other parts of the floor when the user lifts the mop from the bucket and reapplies it to another area of the floor.

Traditional mop systems also require repeated manual wringing and squeezing out of the mop head and lifting of the mop by the user, which is strenuous physical labor that may cause overuse and/or acute muscular skeletal injuries. These types of injuries have recently been the subject of class action lawsuits against entities within the hospitality industry.

Additionally, current mopping systems that re-cycle the contaminated water removed from the floor are energy inefficient because they require filtering and otherwise cleaning all of the water in the mopping system, and not just the newly added contaminated water. This has the disadvantages of: reduced work efficiency by requiring more wait time for the user, increased demand for power, and increased likelihood of bacteria proliferation in the water.

SUMMARY OF THE INVENTION

Disclosed embodiments recognize there is a need within the cleaning industry for a floor cleaning system that automatedly: 1) removes contaminated water from the mop head after each application and refreshes it with clean, disinfected water, 2) then recycles only the dirty water by filtering out the contaminates (versus all of the water), and 3) (optionally) eradicates micro-organisms within the recycled water by various methods, such as by adding disinfectants, detergents, deodorizers and/or applying ultraviolet irradiation. There is also a recognized need for a mop head that is able to repeatedly deliver a sufficient amount of water and cleaning fluids in each floor application, while not dripping or otherwise retaining water and thus becoming a breeding ground for bacteria.

Disclosed embodiments meet these needs by providing a touch-less mopping system used in conjunction with a floor cleaning apparatus (e.g. a mop) as disclosed herein. The term "touch-less" as used herein refers to the user: 1) not having to bend, lean or press any button to activate the mopping system because a sensor is activated when the cleaning head is placed in the rinse tank; 2) not needing to touch or control the filtering process manually; 3) not needing to apply detergent or other disinfectant procedure manually; and, 4) not needing to physically squeeze out or touch the cleaning head.

The mopping system external housing units generally comprise: 1) a rinse tank that automatedly squeezes contaminated water from the used head of the floor cleaning apparatus (e.g. mop head) and refreshes the head with clean, disinfected water; and, 2) a holding tank that filters the contaminates out of the used water, then disinfects and recycles the dirty water (only) for re-application to the floor and re-cleaning of the mop head. The mopping system is configured to suction contaminated water out of the rinse tank, through a filtering system and into a holding tank that retains clean water for later usage by the mopping system, thus recycling the water. In certain embodiments, a dispensing mechanism, in or on the holding tank, may also add disinfectant or other cleaning and deodorizing products to the clean water in the holding tank. Alternatively, an ultraviolet irradiation unit housed within the holding tank, may eradicate micro-organisms (e.g. bacteria, parasites, viruses) living within the contaminated water.

The mopping system further comprises a cleaning mechanism within the rinse tank. The cleaning mechanism automatedly extracts contaminated water from the mop head and refreshes it with clean, disinfected water using one or more of the following mechanisms that 1) squeeze on the mop head sideways and/or underneath, and/or 2) filter debris with or without suction one or more times, and/or 3) use a jet spray to apply a high pressure fluid flow comprising water and/or cleaning solutions, and/or 4) rotates a a conditioning unit to further brush and condition the cleaning head when necessary. And while the cleaning mechanism applies clean, disinfected water to the mop head and conditions it (e.g. via the squeeze unit and jet spray), these fluids are then applied to the floor with the next use of the mop.

In one embodiment, the cleaning mechanism comprises a strainer assembly comprising a first filter to remove large debris prior to the water being circulated to the holding tank, and wherein a suction force may be applied beneath the filter. In one embodiment, the cleaning mechanism comprises a one or more squeeze mechanisms. In one embodiment, for use with flat head mops, the squeeze mechanism comprises a linear actuator, crank or screw mechanism or the like, that applies a squeeze bar mounted on the front and/or back of the wash tank, rearward against the front long side of the mop head. In another embodiment for use with long threaded mop heads, the squeeze mechanism comprises a conditioning unit rolling front to rear one or more times beneath the head to squeeze and wring fluid from the head and to brush any debris out (i.e. "to condition" the head). And in another embodiment, both the front mounted squeeze bar and the underneath mounted squeeze bar are installed within the same mopping system so that the user can clean and disinfect a variety of types of mop heads.

In one embodiment, the cleaning mechanism comprises a jet spray that applies recycled disinfected water onto the mop head and at a high force to rinse contaminates from the head. It is noted that the mopping system may comprise one or more of these specific components-embodiments.

More specifically, the internal components of the mopping system rinse tank may further comprise one or more of the following: 1) a linear actuator, crank, or screw or other means well known to the artisan able to squeeze- and wring out the cleaning head of excess water from the either one or both long sides and/or from underneath the mop head; 2) one or more jet spray nozzles with a pump module comprising one or more circulating-pressure pumps ("first pump") to rinse debris from the head using re-cycled water; 3) a strainer component comprising a first filter system (e.g. a grille or mesh filter) used with a return suction strainer and another pump module (e.g. "second pump") to remove large debris, and to direct waste water from the cleaning apparatus, through a tubing and into the holding tank. The holding tank may further comprise a second filtering system housing one or more filtering cartridges to remove small debris and contaminants, and an (optional) disinfecting system comprising one or more cartridges to add disinfectants, detergents, and/or deodorants to the recycled water and/or to emit ultraviolet irradiation.

Sensors within Mopping System:

The mopping system may further comprise one or more integrated components (e.g. one or more electrical and/or mechanical sensors) within the mopping system to sense: 1) the presence of the cleaning head in a top receptacle of the rinse tank in order to control the activation of spray nozzles to rinse the cleaning head; and, 2) to automatically squeeze out and suction excess water from a cleaning head surface without requiring the user to apply any physical force. Sensors may also detect the pH and/or level of the water in the holding tank, etc. The sensors may direct or indirectly communicate with the control module, such as a printed circuit board (PCB) or a programmable logic control (PLC), which controls the timing of the activation of the pressure-circulating pump module, etc. which in turn controls the level of the water in the holding tank that activates the detergent dispensing or the water circulation.

Automated Water Disinfectant System:

The various embodiments of the present disclosure may further comprise an automated water disinfectant system that is located within or otherwise connected to the holding tank. The disinfectant system comprises one or more disinfectant cartridges that automatedly add disinfectant or other cleaning and deodorizing products to the clean recycled water, and/or exposes it to ultraviolet irradiation, in the holding tank independent of the water level in the holding tank.

Floor Cleaning Apparatus:

The present invention may alternatively or additionally comprise a cleaning apparatus with improved performance due to the use of a proprietary silicone foam material on the end of the apparatus (e.g. mop head). The silicone minimizes the amount of water soaked up by the head, and significantly reduces the amount of bacterial proliferation in the head. The head may further comprise abrasive material to scrub a floor, absorbent material to soak up excess water and/or a hard edge to scrap a floor. The cleaning apparatus may further comprise a quick release means to easily change out the head; and an elongated handle with rubber grips and/or curvature towards the floor to facility the user maintaining a steady grip on the apparatus without having to bend over excessively.

The various embodiments herein may comprise one or more of the following: a touch-less mopping system utilizing re-cycled, sterilized water; a rinse tank with automated spray nozzles and/or automated squeezing-wringing components for the purpose of sterilizing a cleaning apparatus; a method for maintaining a sterile rinse tank using a touch-less mopping system; a floor cleaning apparatus comprising a foam cleaning head for use with the touch-less mopping system; a method for cleaning surfaces through the use of a floor mop with a silicone head; a method for cleaning surfaces with a silicone cleaning apparatus; a floor cleaning apparatus comprising an automatic disinfectant dispenser; a floor cleaning apparatus comprising a water filtration system for re-cycling only contaminated water; and so forth.

The touch-less mopping system provides a constant, rapid supply of re-cycled clean water by filtering and disinfecting waste water that is entered into a rinse tank after usage of a cleaning head in conjunction with the system. In preferred embodiments, the touch-less mopping system is configured to rinse and suction off contaminated water from the bottom portion of the cleaning head. This is all accomplished without the need for any operator effort or interaction.

The touch-less mopping system and its associated floor cleaning apparatus provide a confined sterile operating system that prevents exposure of an operator to contaminants and micro-organisms, both from the surface being cleaned and from the disinfectants and other chemicals utilized in the holding tank.

The touch-less mopping system has an additional advantage over the prior art of being more time and energy efficient by only filtering and sterilizing contaminated water that was removed from the mop head, and not by re-filtering all of the water in the holding tank reserve every time the mop head is cleansed.

In certain embodiments, integrated components provide sensing and automation features for the touch-less mopping system. Certain embodiments of the present disclosure may be further configured to squeeze out and suction off excess water from the cleaning head surface. Still further embodiments may be configured to suction contaminated water out of the rinse tank, through a filtering system and into a holding tank that retains clean water for later usage by the mopping system.

BRIEF DESCRIPTION OF THE DRAWINGS

The above and other features, aspects, and advantages of the present invention will become better understood with regard to the following description, appended claims, and accompanying drawings, not necessarily to scale, where:

DETAILED DESCRIPTION OF EXEMPLARY EMBODIMENTS

Figure 1:
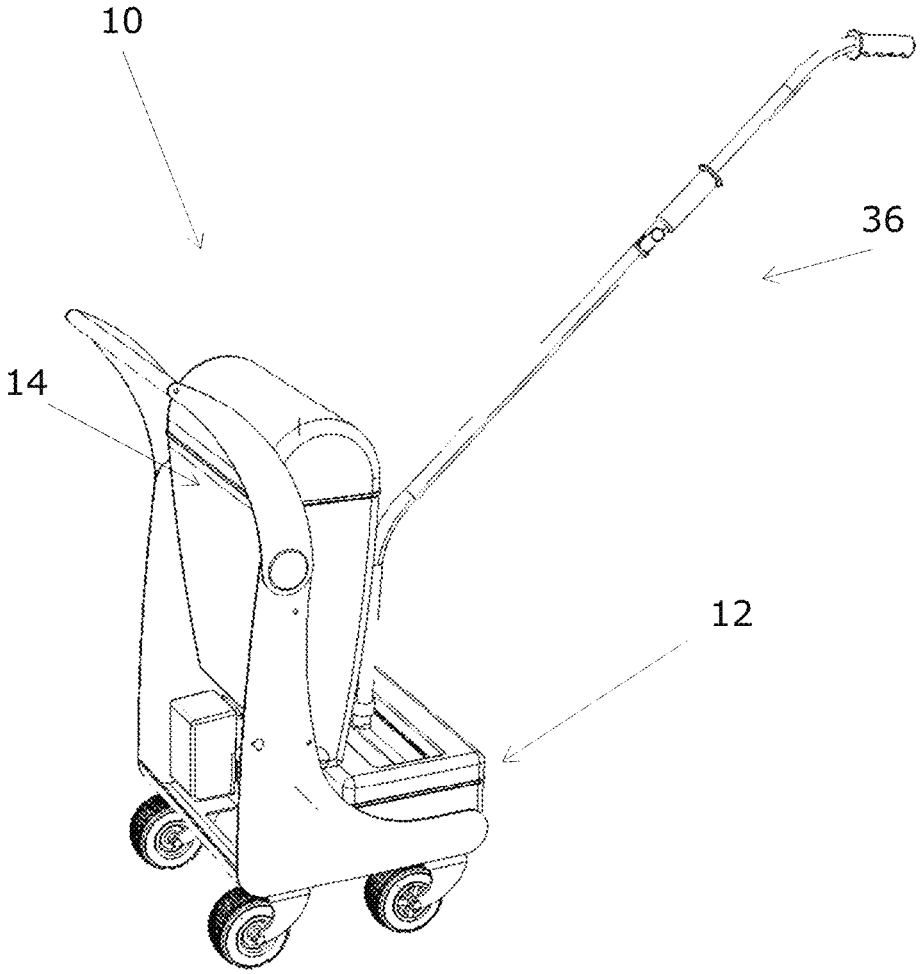
FIG. 1 shows a back perspective view of an exemplary embodiment of a touch-less mopping system with integrated water filtering.

As disclosed herein, the term "Floor" refers to any hard surface upon which the mopping system may operate. For example, the disclosed mopping systems are designed to clean and disinfect floors comprising indoor and outdoor hard surfaces (as compared to carpeted and grassed) upon which a user can safely operate the mopping system 10. Floors may further comprise, for example, showers, and any surface made of one or more of the following materials: tile, marble, cement, concrete, glass, linoleum, etc.

FIGS. 1, 2A-2D and 3A-3D show multiple embodiments including utilization of the various components. As illustrated in FIGS. 1, and 2A-2D, the touch-less mopping system 10 is comprised of the following primary components: a rinse tank 12 to automatedly cleanse a mop head; a holding tank 14 separated from the rinse tank 12; a cleaning mechanism 80 in fluid communication with the rinse tank 12 and the holding tank 14; one or more sensors in communication with the cleaning mechanism 80 and configured for determining that a head 50 of a floor cleaning apparatus 36 has been received in a rinse tank receptacle 41; and, a control module 48 configured to direct the cleaning mechanism 80 to clean the cleaning head 50 of the mop when the cleaning head has been received in the receptacle 41.

Figure 2A:
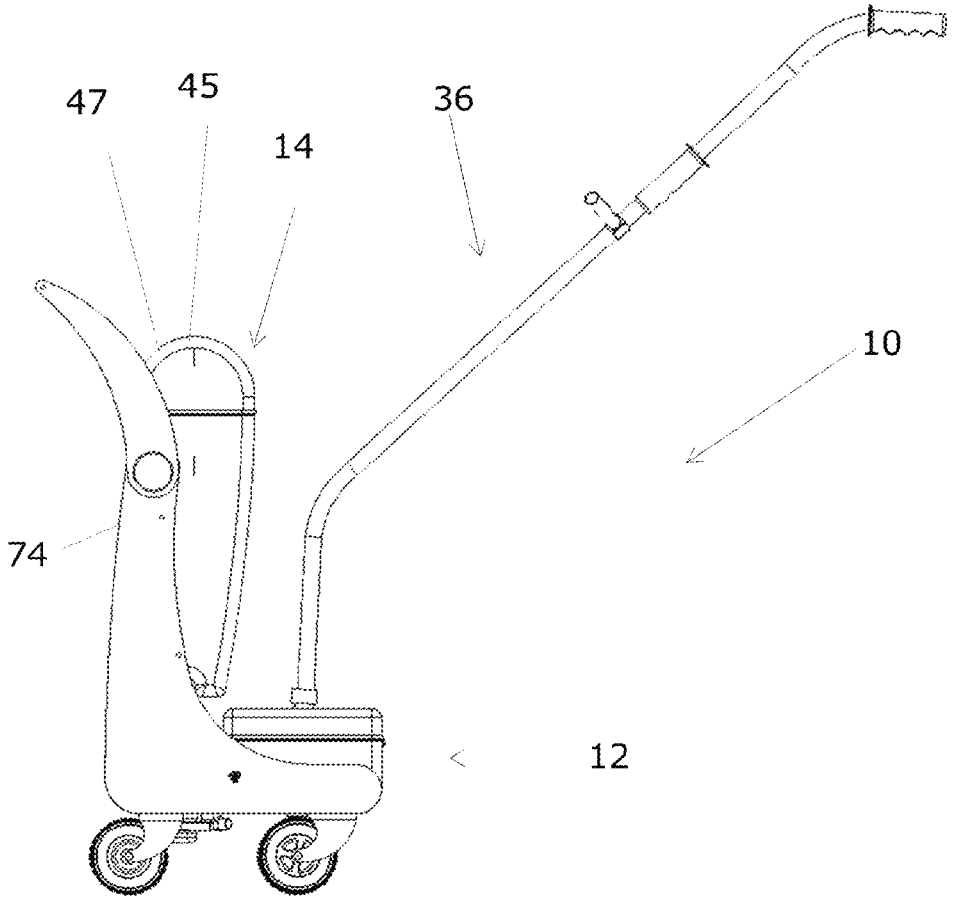
FIG. 2A shows a left side view of an exemplary embodiment of a touch-less mopping system with integrated water filtering and user touchscreen display.
Figure 2B:
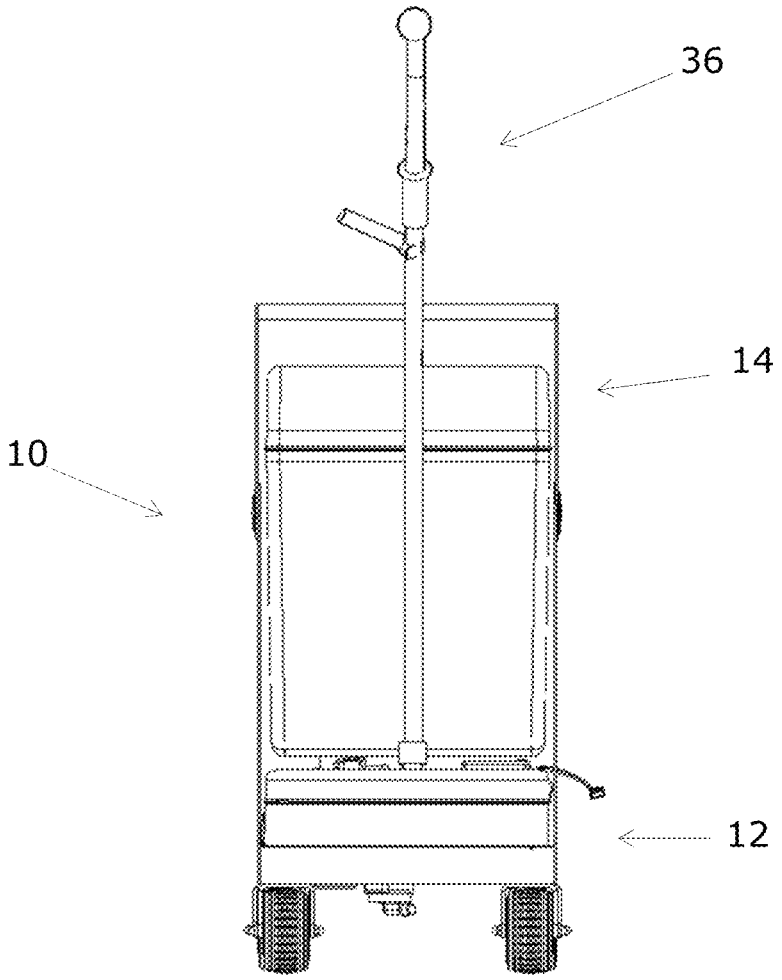
FIG. 2B shows a front plan view of an exemplary embodiment of a touch-less mopping system.
Figure 2C:
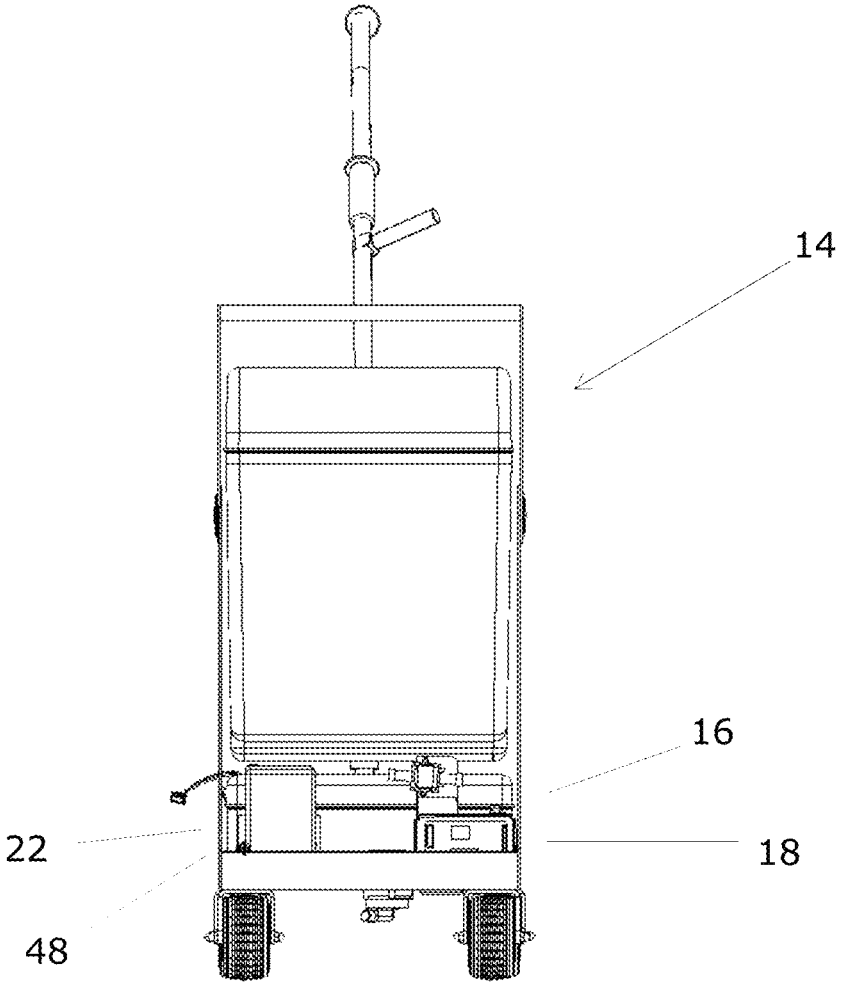
FIG. 2C shows a rear plan view of an exemplary embodiment of a touch-less mopping system.
Figure 2D:
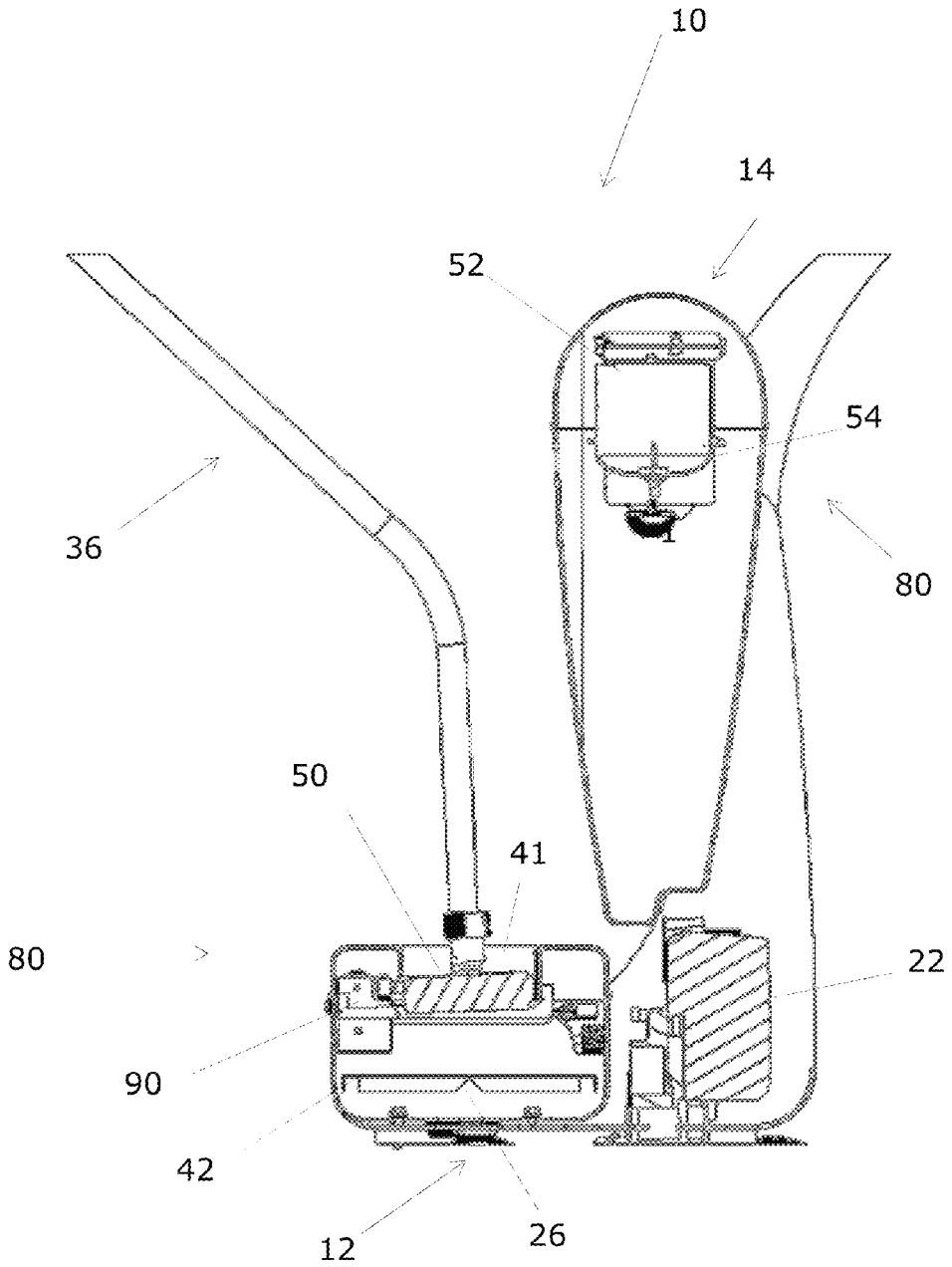
FIG. 2D shows a cross-sectional right side view of an exemplary embodiment of a touch-less mopping system illustrating the internal components of the system.

As shown in FIG. 2D, the cleaning mechanism 80 may comprise one or more of the following mechanisms for removing fluid from the mop cleaning head 50. 1) The cleaning mechanism 80 comprises a first squeeze mechanism 90 with a linear actuator, crank or screw mechanism for wringing-out and squeezing a flat surfaced mop cleaning head on its front, long-side.

2) The cleaning mechanism 80 comprises, additionally or alternatively, a second squeeze mechanism 92 for use with long threaded mop heads, and comprising a rotating conditioning unit able to squeeze fluid from underneath the mop cleaning head and brush any debris away from it.

And, 3) the cleaning mechanism 80 comprises a jet spray 34 with a first circulating pump 18 of the pump module to rinse contaminated water from the head using re-cycled water, and optionally to apply cleaners, and/or disinfectants, and/or conditioners to it after or concurrently with the cleaning water.

And, 4) the cleaning mechanism 80 comprises a strainer assembly to trap large debris from the jet spray's waste, and to move the waste water to the holding tank. The strainer assembly comprises a first filter, such as a stainless steel mesh or grille, to trap large debris; and a suction device 26 (e.g. a cup, funnel, etc.) underneath the filter and operated in conjunction with a circulating-pressure pump module 16 to catch the run-off from the grille and pump it into the holding tank.

5) And, the cleaning mechanism 80 comprises a second filter within the holding tank to remove small debris; and, optionally a disinfectant system used in conjunction with the second filter.

6) And, the cleaning mechanism 80 comprises a second circulation-pressure pump to move clean water from the holding tank 14 back to the rinse tank 12, upon demand.

The mopping system of the various embodiments has the additional advantage of not requiring the user to make physical contact with, or need to exert physical force, to the contaminated mop head 50 in order to rinse, drain excess water from, disinfect, and otherwise clean the mop head 50.

The mopping system 10 further comprises one or more pressure-circulating pumps 16 to generate pressure for the jet spray mechanism 34, and a power source 22, residing on or otherwise incorporated into a wheeled cart comprising an ergonomically designed frame (FIG. 2A, 74).

In an exemplified embodiment, the mopping system is about 16 inches in depth (front to rear), about 33 inches in height, and about 15 inches in width, and incorporated into cart comprising an approximately "L" shaped member parallel to the floor attached to four to six wheels, wherein the frame my further comprise a top curved, ergonomically designed handle to assist the user in maneuvering the system 10 (see FIG. 2A, 74). The bottom of "L" supports the rinse tank, and the top of the "L" houses the holding tank. Other sizes of mopping systems (and floor cleaning apparatuses) are envisioned by the present disclosure, and may be a function of the environment and frequency of intended use.

Figure 8:
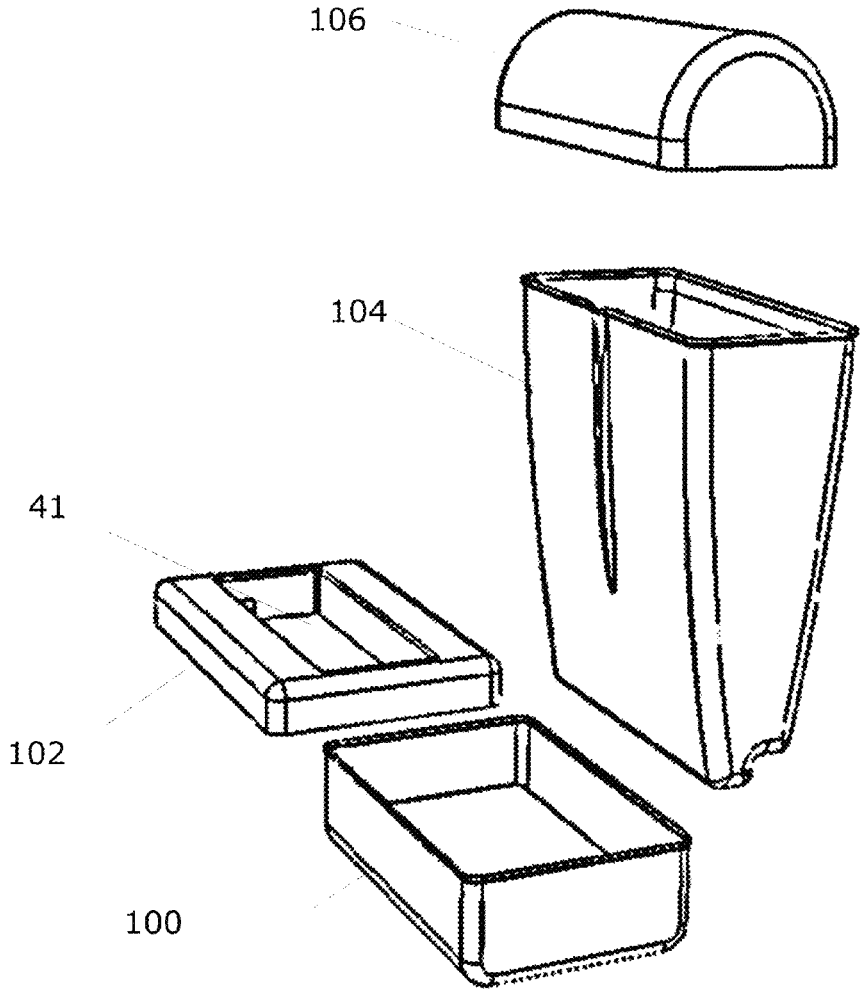
FIG. 8 is an illustration showing the components of the frame of the mopping system.

As illustrated in FIG. 8, the components of the frame further comprises the rinse tank's bottom wash tank 100, the rinse tank's lid 102 with an opening (receptacle 41) for receiving the mop head 50, the holding tank's reservoir for the storing the clean, disinfected water, and the lid of the rinse tank 106.

The mopping system is used in conjunction with a floor cleaning apparatus 36 (e.g. a mop compatible for use with the mopping system 10), such as the one exemplified herein and comprising a cleaning head 50 (e.g. a silicone sponge) on the distal end attached to an elongated, thin, tubular handle extending from the head 50 to the proximal user's end. The exemplified floor cleaning apparatus 36 comprises a total length of about 43 inches (head plus handle), a cleaning head (i.e. mop sponge) about 12 inches in length by about 5 inches in width by about 2.5 inches in thick; and may further comprise a bend of about 30 to about 50, preferably about 45, degrees in the handle near the proximal end to make the head 50 perpendicular to the floor when the apparatus 36 is in contact with the floor during use or while residing within the mopping system 10.

Figure 5A:
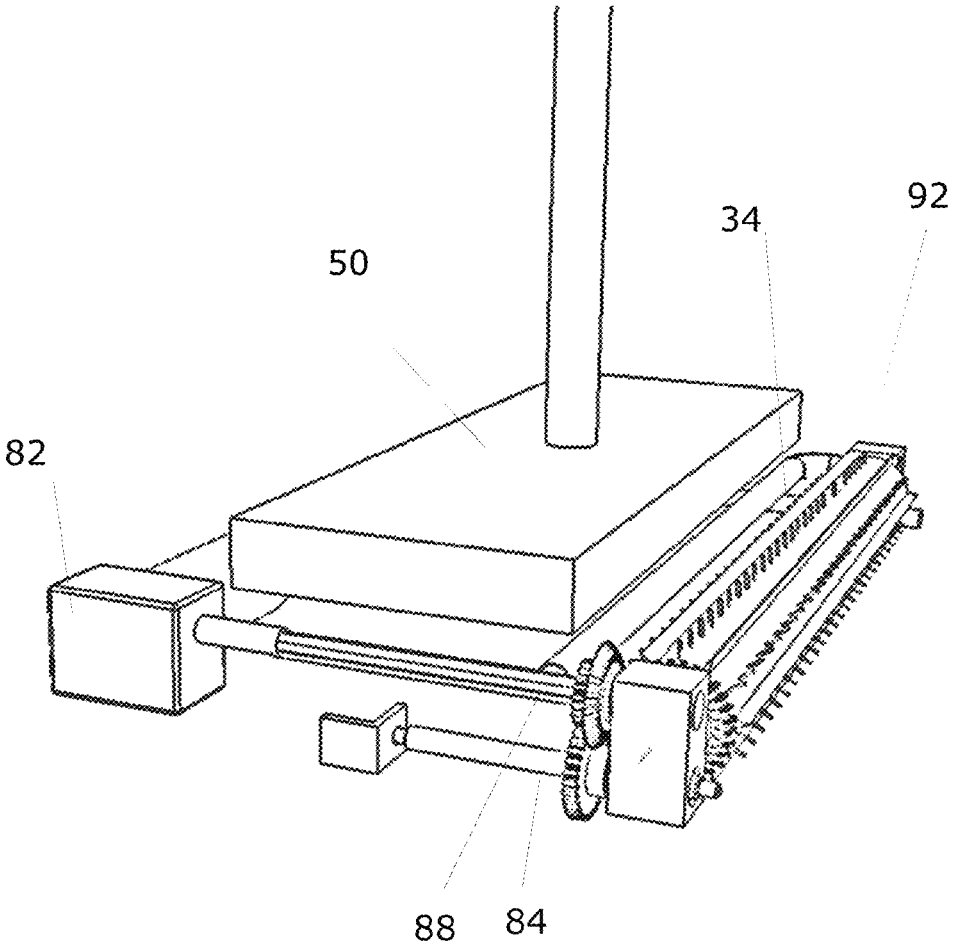
FIG. 5A is a side-rear perspective view of the jet spray, conditioning roller, and squeeze gear mechanism
Figure 5B:
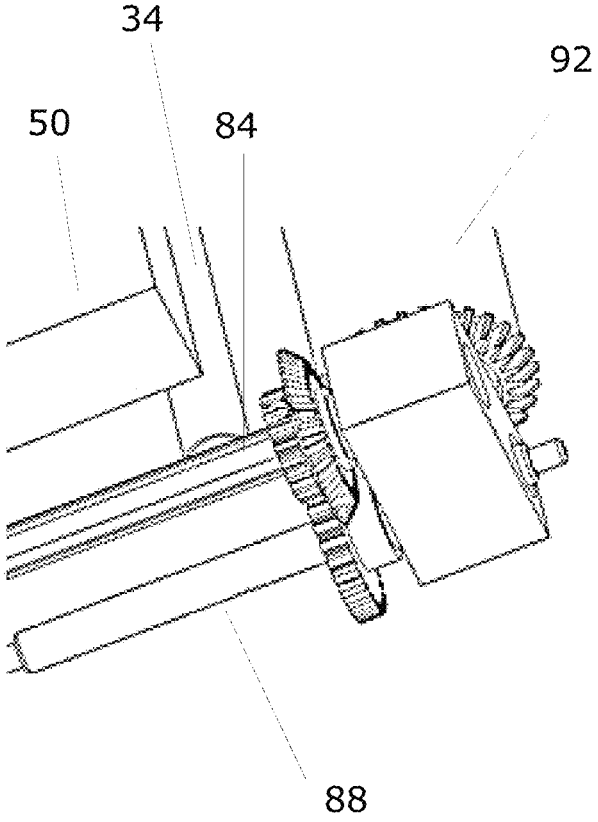
FIG. 5B is a bottom perspective view of the right end, or rear side, of the squeeze gear mechanism.
Figure 5C:
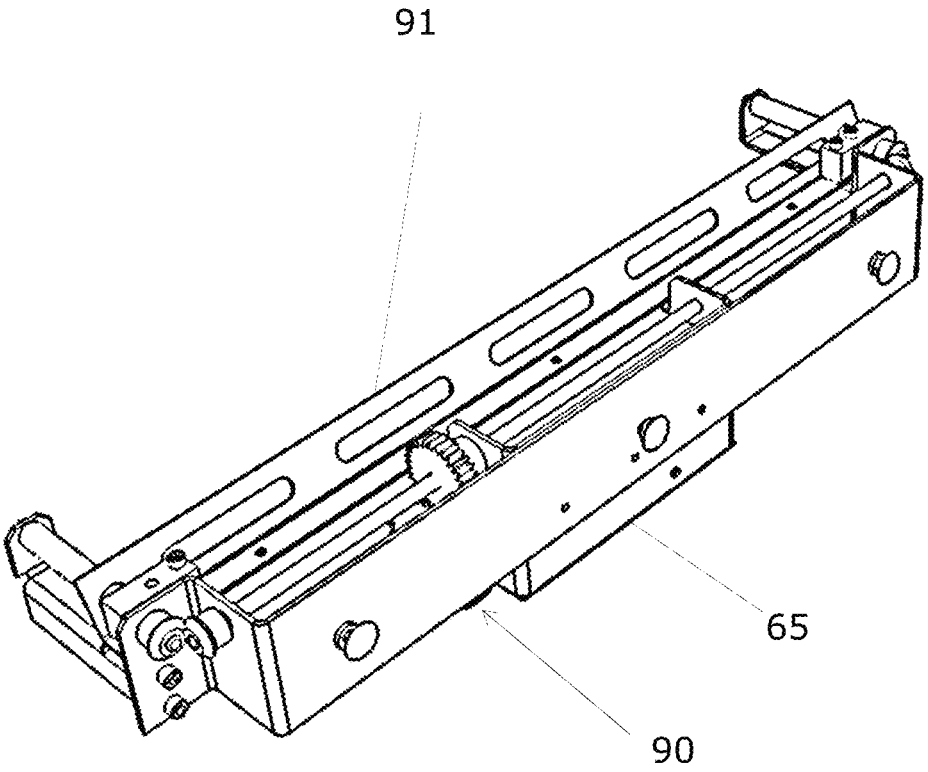
FIG. 5C is a front perspective view of the squeeze mechanism in the embodiment of FIG. 5A.
Figure 5D:
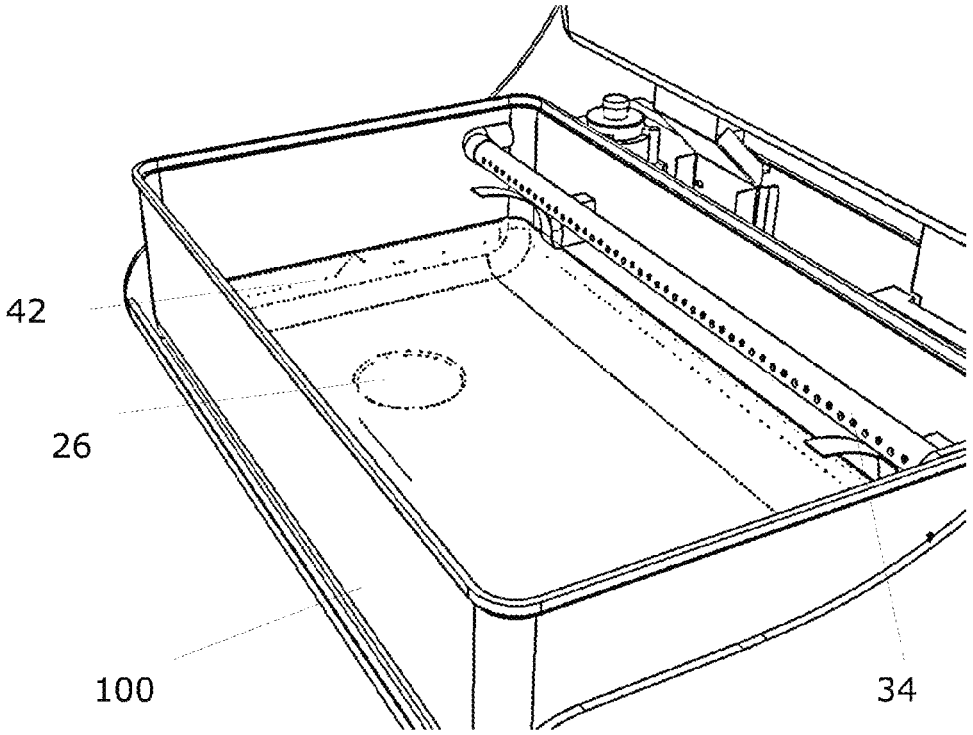
FIG. 5D is a front perspective view of the jet spray bar and the suction strainer in the bottom of the wash tank.
Figure 6:
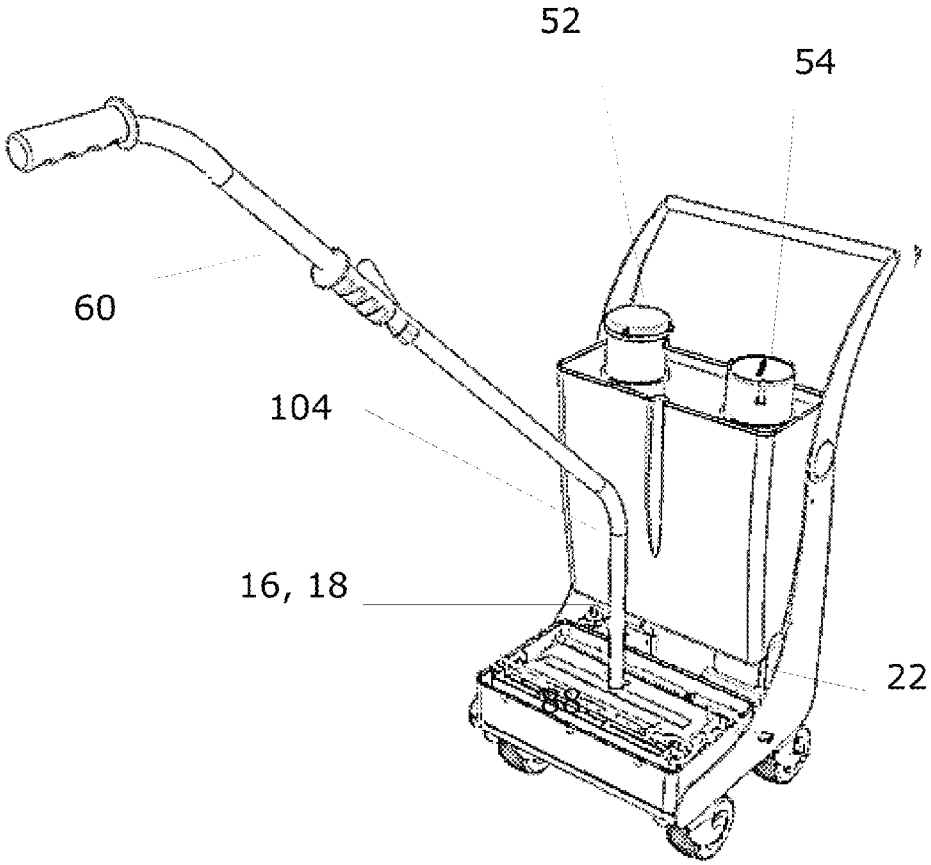
FIG. 6 is a front perspective view of the mopping system and the floor cleaning apparatus illustrating the filter and disinfectant units.

The internal components of the cleaning mechanism 80 of the mopping system 10, as illustrated in FIGS. 2D, 4A, 5A, 5B, and 5D, comprise: a bar 34 with evenly space holes to release a jet spray of water or cleaning solution to rinse debris from the mop head 50; a strainer filter component comprising a mesh filter or a grille with a return suction strainer 26 to remove large debris and to direct waste water from the rinse tank 12 via tubing 40 and into the holding tank 14 for filtering via a filtering system comprising a filtering cartridge 54 to remove small debris, and an (optional) disinfecting system comprising a cartridge 52 to disinfect and recycle the water; one or more sensor mechanisms (not shown) to, for example, detect the presence of a head 50 in the receptacle 41, the pH and/or level of the water in the holding tank 14, etc. As illustrated in FIG. 5A, the mopping system may further comprise a rotating conditional unit 92 with rows of bristles, and a squeezing capacity wherein the unit 92 rolls front to rear, or rear to front, underneath the cleaning head 50, one or more times. It applies conditioning liquids to the mop head and for straightening out mop head surface extensions.

FIGS. 1, and 2A-2D further illustrate the cleaning apparatus 36 attached to the mopping system 10, such as in a stored position or while in use for suctioning the water from the head 50 of the apparatus 36.

And, FIGS. 3A-3D illustrate the cleaning apparatus 36 in the absence of the mopping system 10, such as during use when contacting the floor.

While all of these components may be present in various embodiments disclosed herein, one or ordinary skill in the art would appreciate that there are other embodiments that could be configured with fewer or additional components.

Mopping System

According to an embodiment of the present invention, the rinse tank 12 is configured to allow for the automated cleansing of the cleaning head 50 of the exemplified cleaning apparatus 36 or other similar cleaning apparatus via one or more spray nozzles. In most embodiments, the rinse tank 12 is a horizontally aligned tank with an opening on a top side (i.e. receptacle 41) to allow for insertion of a cleaning apparatus. Other than the spray nozzles 34, the rinse tank may also be configured to house one or more of a strainer component 42 (e.g. mesh filter), a circulating pump module (with one or more pumps), a linear actuator, a crank or screw mechanism, a motor, a sensor mechanism, a conditioning unit or any combination thereof. The purpose of these additional components is detailed below.

In certain embodiments, the opening or receptacle 41 may be partially or fully covered while allowing for the insertion of the cleaning head 50 or a mop sponge, through the opening. In this manner, the rinse tank 12 can remain effectively sealed or prevent splashes or spills of water or other cleaning solution from the rinse tank, particularly during transport or movement of the cleaning apparatus 36 with the mopping system 10. In certain embodiments, the covering members are movably connected to a top wall of the rinse tank via one or more attachment means, such as living hinges. One of ordinary skill in the art would appreciate that there are numerous types of attachment mechanisms that could be utilized with embodiments of the present disclosure. In other embodiments, the covering members may be comprised of a flexible material, allowing for them to bend and return to place upon receiving pressure against them, generally by the cleaning head of a mop.

Figure 7:
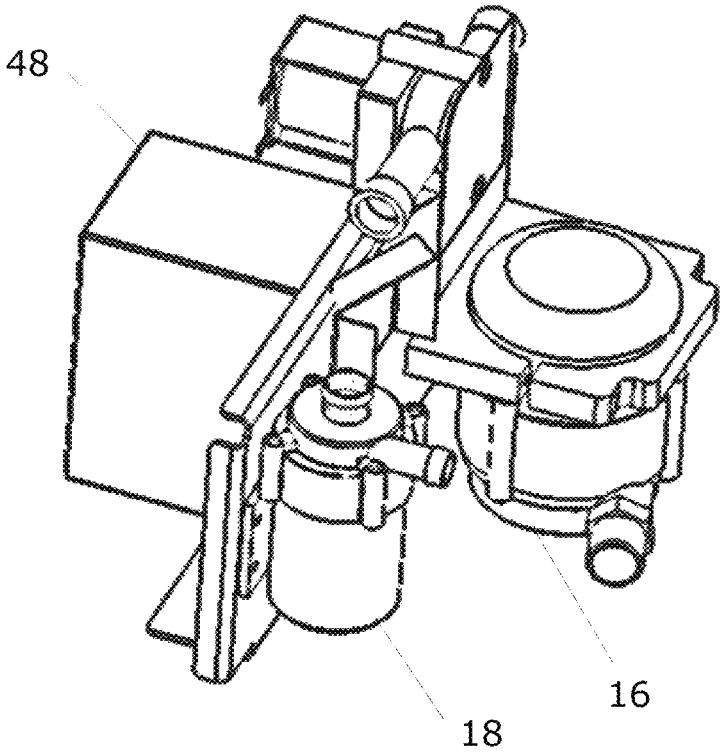
FIG. 7 is an illustration of the control module, and the pump module comprising two pumps.

According to an embodiment of the present invention, the rinse tank 12 may be configured with one or more spray nozzles 34 shown in FIGS. 4A, 5A, 5B, and 5D. These spray nozzles are intended to allow for the spraying and cleansing and (optionally) conditioning of the cleaning apparatus head 50 inserted into the rinse tank. The spray nozzles 34 may be arranged in variable angles depending on the configured cleaning head shape. And, the spray nozzle 34 accelerates cleaning solution, water or other liquid from the holding tank 14 onto the cleaning apparatus head 50 in order to rinse away dirt, particulate or other contaminants from the cleaning apparatus. The spray nozzle works in conjunction with the pressure-circulating pump module comprising pump 18 (see FIGS. 2C and 7) which creates the pressure and acceleration of liquids through the spray nozzle 34. Contaminated water is then suctioned from the rinse tank 12 by the circulating pump module comprising pump 16 (see FIGS. 2C and 7) and passed through the filtering system, comprising a filtering cartridge 54 and a disinfecting cartridge 52 as illustrated in FIG. 2D. In certain embodiments a pressure or circulating pump module 16 (see FIGS. 2C, and 7) may assist or provide for the suctioning from the rinse tank through the filtering system, either in conjunction with or in lieu of the circulating pump module 16.

As illustrated in FIG. 2C, the pressure-circulating pump module 16 may be located in the rinse tank 12, on the rinse tank or otherwise located on or integrated with the touch-less mopping system 10. In a preferred embodiment, the pump module 16 may be a pump that is utilized to draw in liquids from the holding tank 14 and push the liquids through the spray nozzle(s) 34 in order to cleanse a cleaning apparatus 36. In other embodiments, the pressure-circulating pump module 16 may be a reciprocating, rotary or other type pump attached or integrated externally from the rinse tank and connected to the rinse tank 12 and the spray nozzle(s) 34 via one or more tubes or other channels for the passage of liquids.

According to an embodiment of the present invention, the pressure-circulating pump module 18 may be located in the rinse tank 12, on the rinse tank 12, in the holding tank 14, on the holding tank 14 or otherwise located on or integrated with the touch-less mopping system 10. In a preferred embodiment, the pressure—circulating pump module 18 may be a submersible pump which is utilized to draw in liquids from the rinse tank, remove excess water from the cleaning head and push the liquids through a filtering system and into the holding tank. In an embodiment, the pressure-circulating pump module 18 may be configured to suction water or other liquids and debris from the cleaning head of a mop or from another cleaning apparatus in order to remove waste water and contaminants from the cleaning apparatus. In other embodiments, the pump module may be a reciprocating, rotary or other type pump attached or integrated externally from the rinse tank or the holding tank and connected to the rinse tank and the holding tank via one or more tubes or other channels for the passage of liquids. One of ordinary skill in the art would appreciate that there are numerous types of pumps that could be utilized and included in the pressure-circulating pump module and embodiments of the present disclosure are contemplated for use with a variety of types of pumps.

According to an embodiment of the present disclosure, as shown in FIG. 2D for example, the holding tank 14 is configured to store clean, disinfected water (in the bottom of the tank) or other cleaning solutions, mechanisms dispensing cleaning or deodorizing solutions, as well as other components of the invention (e.g. an ultraviolet irradiation unit). The holding tank 14 is a vertically aligned tank comprising a body 104 and a lid 106 (see FIG. 8). Holding tank 14 is connected to the rinse tank 12 in such a manner as to allow fluids to be circulated between the two tanks (e.g. contaminated fluid from tank 12 to 14, and clean, disinfected water from tank 14 to 12). In an embodiment, the fluid connection between the rinse tank 12 and the holding tank 14 is via tubing (not shown) running between the two tanks, with fluids being transferred under the force of one or more circulating or pressure pumps.

According to an embodiment, the holding tank 14 contains a filtering system comprising a filtering cartridge 54, and the tanks contains a disinfecting cartridge 52 as illustrated in FIG. 2D, and a reservoir of clean disinfected water at the bottom of the holding tank 14 (not shown). In other embodiments, the filtering system may be located in the rinse tank, or externally mounted to either the rinse tank or the holding tank. The filtering system may be comprised of one or more parts, including, but not limited to, a particulate filtering component and a strainer component.

According to an embodiment, the strainer component comprises: 1) a suction strainer (see FIG. 2D, 26) embodied by a device located at the end of a suction/inlet pipe or tubing 44 portion of the pump module. The suction strainer connects with a debris strainer grid 26 as the pump module pulls soiled water through the inlet pipe, larger particles and debris are strained off and prevented from moving through the inlet tubing or pipe(s). This helps prevent clogging of the components in the circulation channel (e.g., circulation pump, inlet tube, particulate filtering component, outlet tube).

According to an embodiment, the contaminated water removed from the mop head is immediately cleansed via the various components of the cleaning mechanism 80. This minimizes soiled water contact with the whole system and the time for bacteria to proliferate. It also allows for the water circulation, propelling and filtering process to occur simultaneously with the power rinsing process (without delay or following each other).

According to an embodiment, the particulate filtering component 54 is comprised of a second filter, such as a carbon filter or silicone foam filter, and is interspersed with the water circulation elements anywhere after the strainer component, so that large debris does not become trapped in the particulate filtering component. The purpose of the particulate filtering component is to remove contaminants that are too small to become trapped in the strainer component. One of ordinary skill in the art would appreciate that there are numerous types of particulate filtering components that could be utilized with embodiments of the present invention, and embodiments of the present invention are contemplated for use with any type of particulate filtering component.

According to an embodiment, the holding tank 12 may further comprise a disinfectant discharging unit (disinfectant mechanism) 52. The disinfectant discharging unit may be configured to discharge disinfectant, detergent and/or scent into the clean water tank in order to provide appropriate cleaning solutions to the water before being provided back to the rinse tank for use. In certain embodiments, the disinfectant discharging unit may utilize separate and removable containers located in the clean water tank which are activated by the level of water to disperse a pre-set amount of substance with each water filtration. Additionally, the disinfectant unit 52 is activated by the level of clean water rising in the reservoir, which causes the pushing up the unit's valve to the cartridge. As the valve opens up, the flow of disinfectant is released.

In other embodiments, the disinfectant discharging unit may be electronically controlled and utilize pH or other sensors to detect the quality or pH level of the water and whether additional disinfectants or other products should be discharged into the water.

In other embodiments, the disinfectant discharging unit may further or alternatively comprise an ultraviolet radiation generator to kill micro-organisms residing with the recycled water. For example, the UV generator would emit UV within a range that is mutagenic to bacteria, viruses, parasites, and other micro-organisms. The level and duration of UV emittance would be designed to target specific micro-organisms at exposures and duration well known to one of ordinary skill in the art.

Advantageously, since the disinfectant discharging unit controls the application of chemicals or other products to the water, users of the touch-less mopping system are not exposed to these chemicals, nor is the water subject to overdose of chemicals through human error.

In certain embodiments, the control module FIG. 2C, 48, which comprises a printed circuit board (PCB) or a programmable logic control (PLC), and a circulating pump module allow for the disinfectant dispensing system to work. In an embodiment, the circuit board activates the jet spraying (pressure) part of the pump module first, and after a short duration (e.g., ~10 seconds), activates the circulation pump, part of the pump module. This asynchronous function of the two pumps in the pump module allows for water in the holding tank to rise reaching a higher than average level for several seconds which raises the valve of the cartridge dispenser and allows for some detergent/disinfectant to be released in the filtered water. For the rest of the time, the level of the water in the holding tank is lower which maintains the valve in its standard position closing off the disinfectant dispenser. Other methods of releasing disinfectants into the filtered water are known to one of ordinary skill in the art.

In certain embodiments, the circuit board, or other control element(s), may be configured to control, monitor and process one or more of the elements described herein. For instance, the circuit board could be configured to perform functions including, but not limited to: pump module control, sensor data analysis and control, updating of a display element, location tracking, spray nozzle control, error reporting, water status reporting, water status analysis, filter system, status, filter system errors or any combination thereof. One of ordinary skill in the art would appreciate that there are numerous types of control, monitoring and processing that could be provided by a circuit board or other control element, and embodiments of the present invention are contemplated for use with any such circuit board/control elements.

Sensors:

According to an embodiment, the sensor mechanisms are configured to provide sensor capabilities to one or more aspects of the touch-less mopping system. A first sensor mechanism is configured to detect the entrance of a floor cleaning apparatus head or other cleaning apparatus into the rinse tank receptacle 41, such that the power rinse feature is engaged (e.g. jet spray nozzles 34 creating a high pressure rinse of the head). In a preferred embodiment, this first sensor mechanism may be a "paddle switch" (large contact area) located diagonally in the front corner area of the rinse tank, which is mechanically connected to a sealed low voltage electrical switch. When placed in the rinse tank, the cleaning apparatus will contact a sufficient area of the paddle switch which then activates the sensor and initiates the power rinse process comprising the jet spray nozzles. When positioned in idle (traveling) position, the cleaning head is reclining towards the back wall of the rinse tank 12 and is thus prevented from contacting the paddle switch allowing the sensor to be in idle, inactive mode. Advantageously, this first sensor mechanism allows an effortless way of activating the power rinse process without requiring any bending or repetitive mechanical action. As a result, the various embodiments herein disclose a hard surface floor cleaning system that does not require the operator to engage in any physical labor to clean the mop head.

In certain embodiments, the usage of a cleaning apparatus 36 with a silicone foam head 50 (as described herein) is advantageous due to the special engineered consistency of a silicone foam cleaning head, which makes it harder than regular cotton or fiber mop heads. The consistency allows for the activation of the paddle switch, while the porous and lightweight silicone foam head is easily cleaned and portable. In other embodiments, the cleaning apparatus could be comprised of other materials, such as cellulose or other foam materials. One of ordinary skill in the art would appreciate that there are numerous materials that the cleaning apparatus could be made from, and embodiments of the present invention are contemplated for use with any type of material.

In certain embodiments, the sensor system may be configured to allow for active and idle sensing modes, allowing the whole mechanism to be activated solely when intended. Thus the power source (e.g., battery) is not overused and is utilized only for specific processes (rinse, wringing and other). The idle and active position switching also allows a cleaning head or other cleaning apparatus to be inserted into the rinse tank diagonally in idle mode while awaiting its next use. Again, this saves labor and any physical effort (bending, squatting) associated with having to pick up a lying mop.

According to an embodiment, the sensor mechanism may be further comprised of a second sensor for sensing filter quality and endurance. The second sensor is connected to or inserted within the filter component. As illustrated in one embodiment in FIG. 2A, a human readable display 45 is utilized to show the user of the touch-less mopping system the current status of the filter, and the display may be mounted on the outside of the system. It may also display when the filter is ready to be replaced. The human readable display could be one or more of an LED indicator array (e.g., green, yellow, red status lights), a LCD display, a touch-screen display 47 or any combination thereof. One of ordinary skill in the art would appreciate that there are numerous types of human readable displays that could be utilized with embodiments of the present disclosure and various embodiments of the present disclosure are contemplated for use with any type of human readable display.

According to an embodiment of the present invention, the sensor mechanism may be further comprised of a third sensor, comprising a pH level sensor. This third sensor may be connected to, integrated in or mounted on the holding tank and integrated with the use of a printed circuit board (PCB) unit or a programmable logic control (PLC), (or other similar unit configured to process information, such as a computing device or other electronic component). This pH level sensor (third sensor) indicates when the pH level is too low or high and hence more detergent needs to be added. When the information is relayed to the PCB/PLC unit, it activates the proper mechanism to dispense more detergent/disinfectant. This third sensor guarantees appropriate pH level of cleaning water so that it neutralizes/kills micro-organisms. In certain embodiments, the human readable display component may be configured to receive information from the pH level sensor and display information related to the pH level to the user.

According to an embodiment of the present invention, a thin vertical crevice (receptacle 41, FIG. 2D) on the outer wall of the clean tank allows for cleaning head to be anchored in while the whole mop system 10 plus the cleaning apparatus 36 are in transit. This allows the user to move the entire system by simply pulling on the cleaning apparatus 36 handle. Due to this ergonomic improvement, the user does not have to squat down or bend to reach the mop handle when they are ready to use the whole system.

Automated Head Rinsing and Contaminated Water Extraction Mechanisms

The cleaning mechanism 80 automatedly rinses and extracts contaminated water from the mop head 50 and replenishes it with clean, disinfected water using one or more of the following mechanisms that 1) squeeze, and/or 2) filter debris with or without suction, and/or 3) uses a jet spray of water and cleaning fluids.

In one embodiment, the cleaning mechanism 80 comprises a strainer assembly 42 comprising a first filter to remove large debris prior to the contaminated water being circulated to the holding tank, and wherein a suction force may be applied beneath the filter.

In one embodiment, the cleaning mechanism 80 comprises a squeeze mechanism comprising a linear actuator, rotating crank or screw able to squeeze fluid from the mop cleaning head by using squeeze bars 91 to apply a horizontal force to the front long side of the mop cleaning head. In another embodiment, a squeeze bar 91 is mounted on both the front and rear wall of the wash tank (FIG. 8, 100) so as to apply a horizontal force to both long sides of the mop head.

In one embodiment, the cleaning mechanism 80 comprises a squeeze mechanism with a roller 92 moving rear to front, one or more times, beneath the mop cleaning head and able to squeeze fluid from the head.

In one embodiment, the cleaning mechanism 80 comprises a jet spray 34 that applies re-cycled disinfected water onto the mop head 50 and at a high force to rinse contaminates from the head.

According to an embodiment illustrated in FIGS. 4A and 5A-C, a squeeze unit 90 comprising a horizontal squeeze bar 91 is mounted on the front of the rinse tank 12, and may comprise a linear actuator, crank or screw mechanism, or the like, for applying a horizontal force along the front long side of the mop head. Furthermore, a main drive motor 64 rotates the main and minor drive shaft 88, 84 which are connected to two left and right hand mitre gears that rotate two left and right hand lead screws in the same direction. They are in turn connected to right and left side drive boxes 82, which propel the squeeze bar 91 to move rear to front, one or more times, thus squeezing the mop head side. The mop head 50 may further be squeezed from underneath. A drive motor (not shown) connected to an auxiliary gear train 82 drives the rotating conditioning (squeeze) unit 92 in a rotational direction backwards and forwards (i.e. long side-to-long side of the mop head), underneath the cleaning head 50. The jet spray bar 34, which is attached to the unit 92, thus moves with unit 92 to clean the underside of the mop head 50.

According to an embodiment as illustrated in FIGS. 4A and 5A-C, a squeeze mechanism 90 is configured to squeeze and/or wring the cleaning head 50 of excess water. Propelled by a drive motor 65, drive shaft (not shown) and gears (not shown), the squeeze mechanism 90 making contact with one or more squeeze bars 91 located on the long side of the mop head 50 located in the rinse tank 12 and hugs the cleaning head's on its opposing long sides, pushing them inward and then letting them free. As the one or two squeeze bars 91 (front and back mounting not shown) close in tightly on the bottom surface of the cleaning head, they act as a squeezing device wringing out excess water from it. Once the linear actuator or screws move back and release the pressure, the bar(s) 91 retract to their original position. In an embodiment, the linear actuator, crank or screw is a horizontally aligned to the front wall of the rinse tank 12 in close proximity to the bars 91. In another embodiment, bar 91 is mounted on the rear wall of the rinse tank 12, alternatively or additionally. In other embodiments, the actuator, crank or screw may be located in a separate tank, or externally mounted to either the rinse tank 12 or the holding tank 14. This automated wringing component completely does away with the need for the operator to exert effort and wring the excess water from the cleaning head manually. Effectively, it reduces the level of strenuous work applied by operators and minimizes any potential spinal injuries typically caused by such manual labor.

In other embodiments of the present invention, the wringing means may include, but is not limited to motorized wringing mechanisms and other similar means for wringing out a cleaning apparatus inserted into the rinse tank. For example, the linear actuator may be replaced by alternative automated wringing means (e.g. a motor and drive belt) and the flaps may be replaced by alternative components (e.g. lead screws).

Figure 4A:
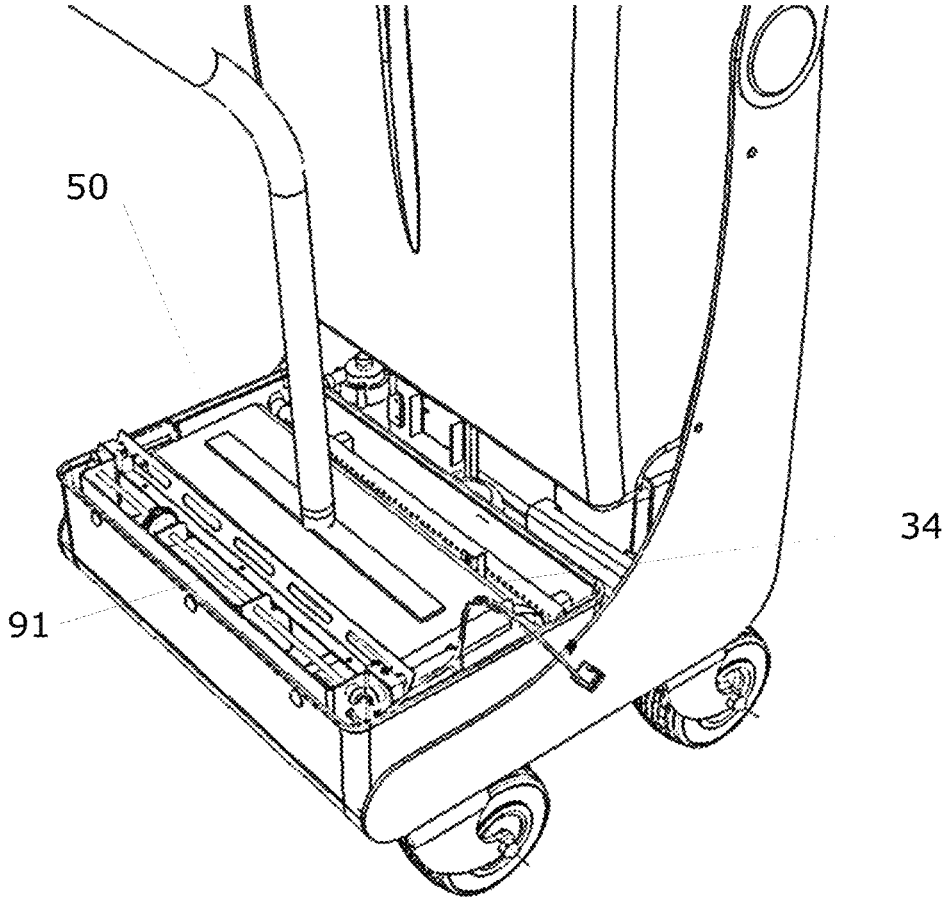
FIG. 4A is an illustration of one embodiment of the rinse tank for automatedly and mechanically squeezing contaminated water and debris from the head of the floor cleaning apparatus via a linear actuator squeeze unit.
Figure 4B:
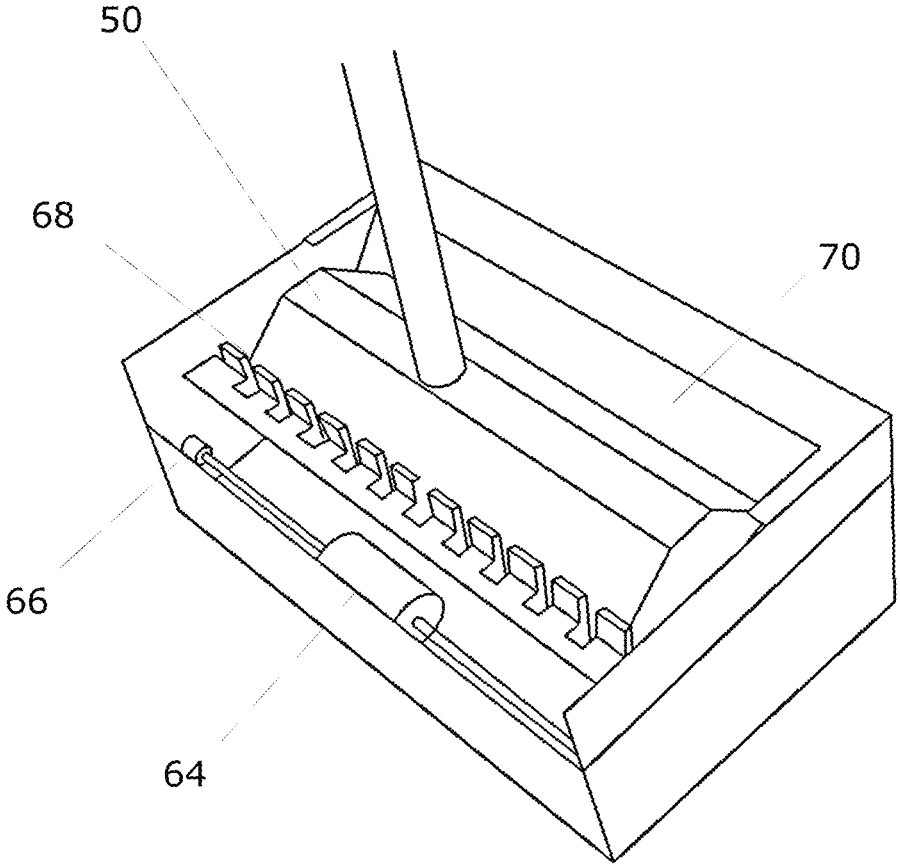
FIG. 4B is an illustration of another embodiment of squeezing the mop head via motor driven lead screws.

In one embodiment, as illustrated in FIG. 4B, a motor 64 will activate a drive belt 66 which in turn will move a row of lead screws 68 in and out thus squeezing the head 50 along one length and forcing it against a back member 70 which squeezes it simultaneously along its opposing length.

One of ordinary skill in the art would appreciate that there are numerous types of automated wringing and squeezing mechanisms that could be utilized with embodiments of the present disclosure, wherein the two terms may be interpreted as being synonymous, or part of one process—i.e., concurrent; and/or sequential processes.

Automated Location Tracking

According to an embodiment, the touch-less mopping system may further comprise a tracking means to determine the exact location of the system. In a preferred embodiment of the present invention, the tracking means may be selected from the group comprising a Global Positioning System (GPS), Radio Frequency Identifier (RFID), cellular triangulation means or any combination thereof. One of ordinary skill in the art would appreciate that there are numerous types of tracking means that could be utilized with embodiments of the present invention and embodiments of the present invention are contemplated for use with any tracking means integrated on or in the touch-less moping system, allows for the touch-less mopping system to be tracked and located with ease and convenience. The tracking system may link to a remote computing system configured to track and identify the location of the touch-less mopping system. Uses for the tracking system include, but are not limited to, tracking the touch-less mopping system for anti-theft purposes, tracking the touch-less mopping system for sanitation purposes (e.g., recording movements of the touch-less mopping system in order to identify which areas have been cleaned), tracking the touch-less mopping system for determining proximity to an area in need of sanitation, or any combination thereof. One of ordinary skill in the art would appreciate that there are numerous uses for the tracking means that could be utilized with embodiments of the present invention and embodiments of the present invention are contemplated for use of the tracking means.

In addition to tracking the location of the cleaning system, another embodiment comprises the mop cleaning system 10 comprising sensors that track the user's location, and/or a remote control device in communication with the system 10 (e.g. drive motors communicating with the control module 48), to control the movement of the system 10. For example, the system 10 could comprise sensors to follow a user and/or be linked to a remote control device (e.g. Bluetooth® enabled) so that the user can move the system without having to touch it. One of ordinary skill in the art would readily mount the tracking sensors and link a remote control device to the system 10. This embodiment would thus move the mopping system 10 in an automated, robotic like manner without the user being required to physically push, pull, and otherwise exert force to direct the movement of the system 10.

Floor Cleaning Apparatus

The floor cleaning apparatus 36 may comprise any standard rectangular shaped mop well known in the art that comprises a head 50, with two opposing long sides and two opposing short sides, stiff enough to activate the system sensors 10, or the one disclosed herein, as long as the cleaning head 50 comprises one or more absorbent pieces of material (sponge, fabric, etc.) to apply clean water to and to soak up excess water from the floor. Preferred embodiments of the present invention are configured for use with a cleaning apparatus utilizing a proprietary silicone foam cleaning head 50 as detailed herein, as illustrated in FIGS. 3A-3D.

In one embodiment, the mop cleaning head 50 is constructed from a proprietary silicone foam composition that is durable and sturdy. The closely knit cells of the mix prevent it from over-absorbing water (e.g. prevents dripping and splattering of water when the apparatus is lifted). Most cleaning products nowadays use polyethylene foam. Polyethylene is an open-cell structure and one cannot limit the amount of water it absorbs, i.e. it absorbs a lot of water. Moreover, the manufacturing of polyethylene foam requires the use of isocyanate, which is toxic. Silicone foam on the other hand, can have a closed cell structure. The pure manufactured form has a smooth, impervious skin. In the various embodiments, the silicone is manufactured to control how much water it absorbs by shaving off the skin and piercing small holes into its porous structure, thus allowing water to be absorbed but also controlling the absorption level. That allows one to create numerous, calculated levels of absorption tailored for various cleaning surfaces. Additionally, the by-product of silicone foam manufacturing is nitrogen which is a clean substance and can be reused/sold for other purposes.

Through carefully engineered pierced holes (channels) in the non-porous silicone substance, the various embodiments herein control the amount of water that the silicone cleaning mop head soaks up. Advantageously, the silicone foam cleaning head described herein prevents excessive water absorption, hence minimizing the dripping off of water as the mop is lifted. Additionally, the mop cleaning head of the various embodiments limits bacteria proliferation throughout the foam cleaning head as less water is absorbed, since micro-organisms require water to exist.

Figure 3A:
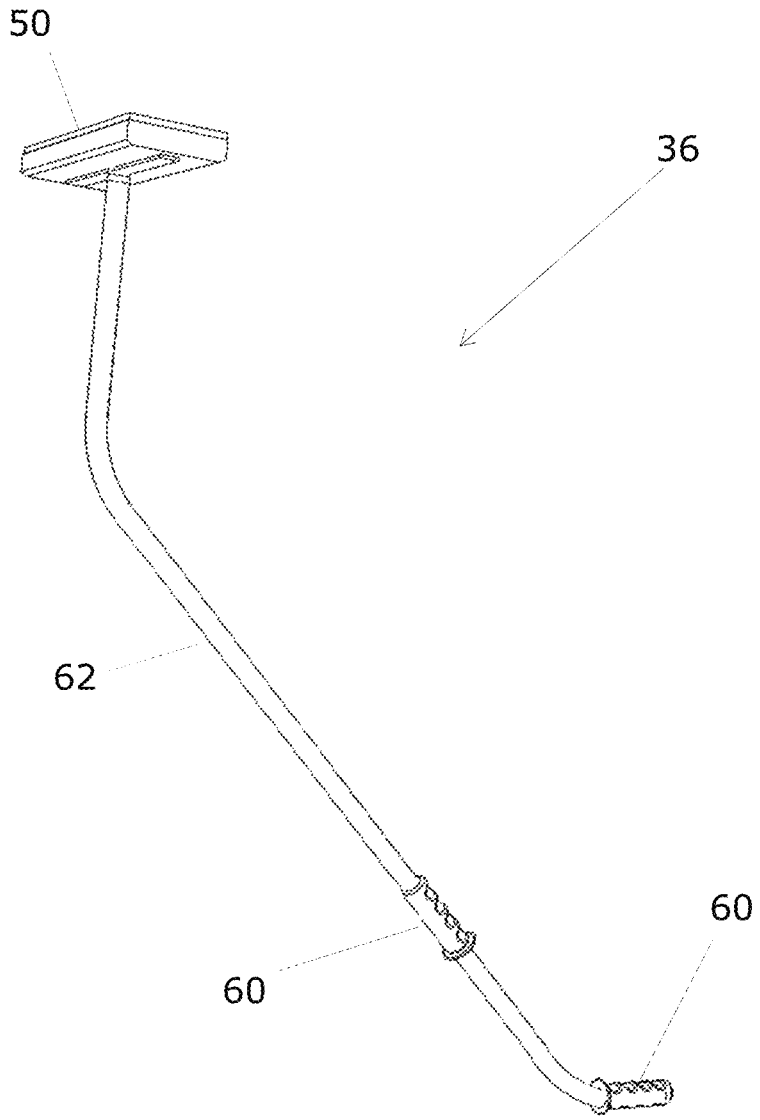
FIG. 3A shows a perspective view of an exemplary embodiment of a floor cleaning apparatus with a flat surface cleaning head.
Figure 3B:
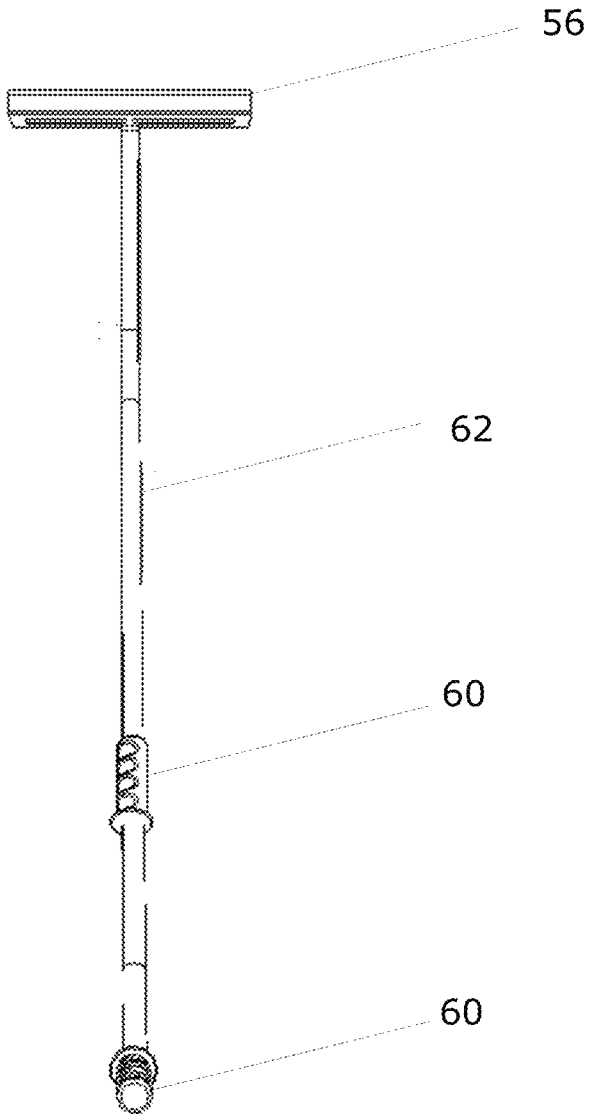
FIG. 3B shows a top plan view of an exemplary embodiment of a floor cleaning apparatus with a flat surface cleaning head.
Figure 3C:
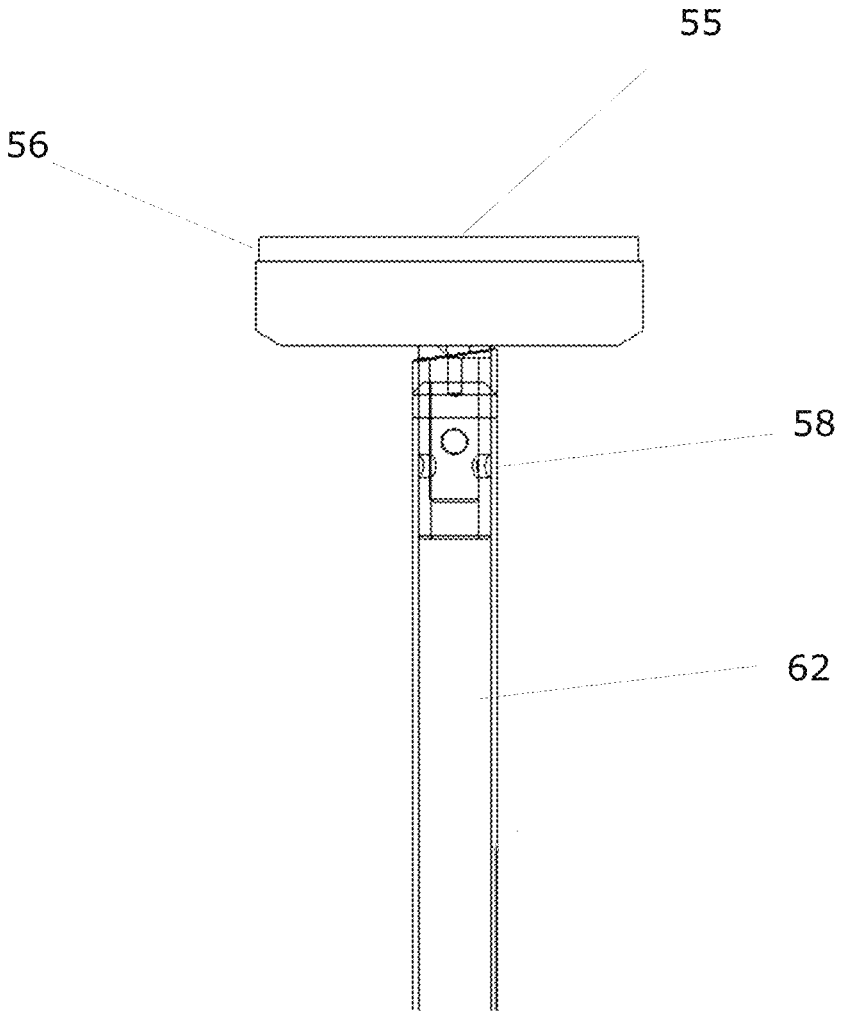
FIG. 3C shows a close up, top plan view of an exemplary embodiment of a floor cleaning apparatus with a flat surface cleaning head and a quick release mechanism to detach the mop head in one user movement or action.

And while the head 50 is sufficiently porous to hold and deliver water, it is also solid enough to activate the sensor mechanism (e.g., paddle switch) when the head is placed within the rinse tank's receptacle 41. The cleaning apparatus head 50 may further comprise a scrubbing surface to generate an abrasive force when the apparatus 36 is applied to a floor by a user. As illustrated in FIG. 3C, in one embodiment, the head 50 may further comprise a pad 55 made of abrasive material and attached to one or more surfaces of the head 50 that makes contact with the floor when in use. And, the head 50 may alternatively, or additionally comprise, a hard edge 56 made of metal or plastic to scrap a floor when the apparatus 36 is in contact with a floor (see FIGS. 3B and 3C).

Additionally, the floor contact side of the mop head 50 may comprise a variety of shapes, such as a flat surface. In another embodiment, the head 50 is made of a microfiber with an even surface comprising long threads.

The cleaning apparatus head 50 is attached on the distal end of a lightweight tubular elongated handle member 62. The tubular handle member 62 further comprises a curvature or bend of about 30-50, or about 45, degrees towards the floor and near the proximal end of the member 62. The member 62 may further comprise one or two or more ergonomic rubber grips (FIGS. 3A & 3B, 60). The grips and the curvature facilitate the user maintaining a steady grip on the apparatus 36, but without having to bend over excessively.

Figure 3D:
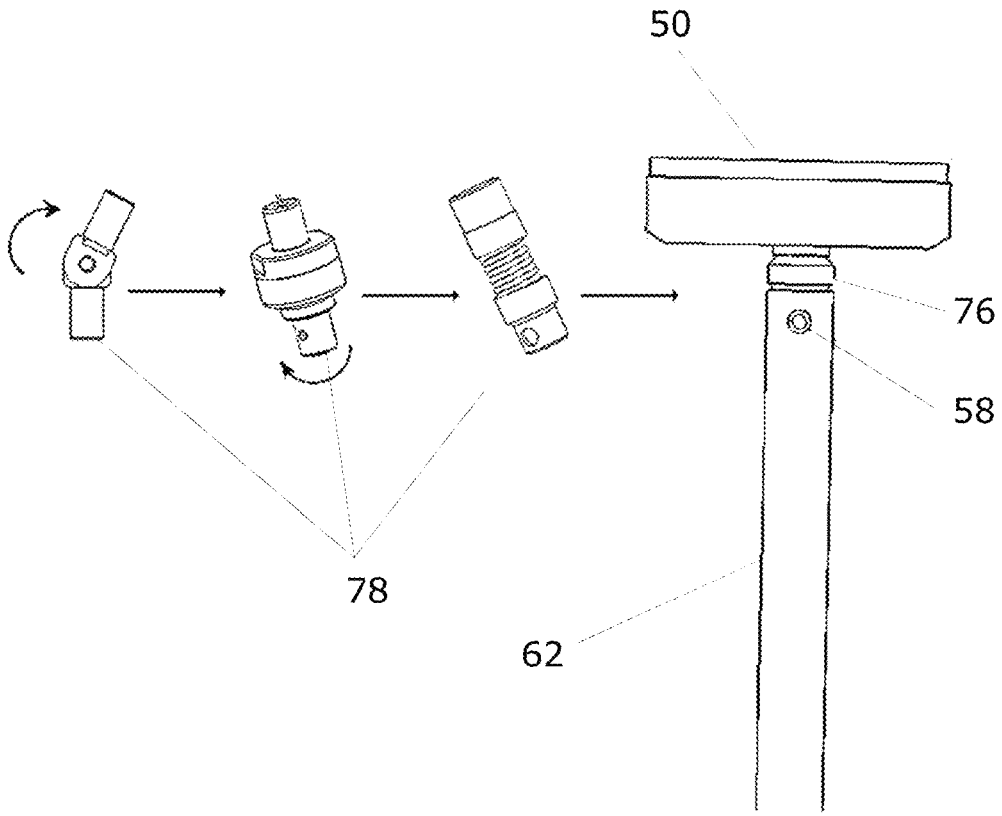
FIG. 3D shows a close up top plan view of exemplary embodiments of the joint connecting the mop head to the mop handle.

The cleaning apparatus head 50 may further comprise a quick release mechanism 58 to easily change out the head 50, as exemplified in FIGS. 3C and 3D, such as to the exemplified heads with scrubbing pads. The head 50 may further comprise the ability to lock in place every 45 degrees in a 360 degree, or less, range of motion.

And, as illustrated in FIG. 3D, in another embodiment the head 50 is able to move in a variety of directions due to a joint member 78 at the junction 76 residing between the tubular member 62 and the underside of the head 50 (which is separate from the lock-in mechanism with a quick release 58). The joint member 78 may comprise a variety of types of joints well known to one of ordinary skill in the art, such as ones that are able to cause the head 50 to forward swivel, rotate and lock in every 45 degrees within a 360 degree, or less, range of motion degrees, and flex side-to-side, back-to-back. The tension on the member 78 can also be adjusted to have the head 50 swivel loosely or tightly. In one or more embodiments, the joint member 78 may comprise one or more parts to enable the mentioned functions.

In additional embodiments, the handle 60 is ergonomically designed with one or more variable curvatures/bends located at various positions along the length of the handle. This allows for cleaning under various objects without bending down and is designed to reduce repetitive straining injuries.

Method of Use—Exemplification

In one embodiment, the mopping system 10 and the floor cleaning apparatus 36 are used as per the following method to clean a hard surfaced floor without requiring a user to be exposed to contaminated, infected water, or to have to apply physical force to remove the contaminated water from mop head 50. The steps of the method comprise one or more of the following steps, which may be in alternative orders.

In step one, provide a floor cleaning apparatus 36 comprising: i) a cleaning head 50 located on the distal end of the apparatus, and configured to apply and soak up water and contaminates from a floor; and, ii) an elongated, thin, tubular handle member 62 extending from the proximal user's end to the cleaning head 50 on the distal end.

In step 2, provide an automated mopping system 10 comprising, i) a rinse tank 12, comprising a mechanism to automatedly clean the head 50 by removing excess contaminated water and debris from the cleaning apparatus head without requiring the user to exert physical force, while adding disinfected water and conditioners to the head; and, ii) a holding tank 14, comprising a mechanism to transport clean re-cycled water to the rinse tank 12 to facilitate cleaning the head 50.

In step 3, inserting the cleaning mop head 50 into receptacle 41 of the rinse tank 12 and thus activating a detection sensor, such as a paddle switch located within the receptacle 41.

In step 4, the contaminated water and debris are automatedly removed from the mop head 50, while the head is disinfected and conditioned. In one embodiment, the water and debris are removed via a linear actuator squeezing the mop head 50 as illustrated in FIGS. 4A and 5A-C. In other embodiments, the head 50 can be cleaned via a rotating crank or screw system by methods well known by one of ordinary skill in the art.

In yet another embodiment, a microfiber long-threaded mop head can be cleaned via the mechanism illustrated in FIG. 5A-5D. As soon as the sensor detects the presence of the mop head in the receptacle 41, the jet spray bar 34 is activated via a first circulating-pressure pump 18 to rinse the underside of the mop head 50. The source of the sterile water is from the holding tank reserve. A conditioning (squeeze) unit 92, that comprises cleaning bristles and squeeze blades, rotates and moves (front to rear and back one or more times) underneath the head 50 to squeeze and brush the head. A spray bar 34 that is fixed to the wash tank, continually supplies the pressurized water or cleaning fluid. The rotational and linear motion of the roller 92 and the spray bar 34 are under the operational control of the cleaning mechanism 80 (i.e. the exemplified drive motor and gear box 82, the main splined drive shaft 88, and the linear drive screw 84). The rotational and linear motion of the roller 92 is driven mechanically through a spline driven spur, mitre gear combination, that are powered by a low voltage reversing gear motor.

In step 5, which occurs after or currently with the cleaning of the mop head 50, the contaminated water and debris that was removed from the mop head 50 is suctioned from the rinse tank 12 (via a second pressure-circulating pump 16) and pumped into the holding tank 14. The suctioning process may further comprise suctioning the water through a strainer 26 component able to filter large debris from the contaminated water before moving the water into the holding tank.

In step 6, once the contaminated water is within the holding tank 14, it is passed through a filtration cartridge 54 to remove small debris and contaminates. It is noted that only the new contaminated water is filtered, and not all of the water in the holding tank's reserve. Additionally, the water may be run through a disinfectant process 52, by for example, adding a disinfectants, detergents, and/or deodorants to the water, and/or by irradiating the water with ultraviolet radiation at a dosage sufficient to eradicate microorganisms in the water.

In the final step, the cleaned, disinfected, recycled water is held in the holding tank 14 and returned to the rinse tank 12 as needed in subsequent cleaning sessions, such as for use in the spray nozzle bar 34 to clean the mop head 50.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

What is claimed is:

1. A touchless, recycling cleaning system for hard surfaced floors comprising, a) a floor cleaning apparatus comprising a mop cleaning head on a distal end of a tubular handle member, and further comprising a bend in the tubular handle member to orient the mop cleaning head parallel to the floor;

b) a mopping system comprising:

a rinse tank with a top side receptacle able to receive the mop cleaning head, said rinse tank able to automatedly remove a contaminated water from said head, and to refresh said head with a recycled water;

a holding tank separated from the rinse tank, able to filter the contaminated water and to store the recycled water;

a cleaning mechanism within the rinse tank and/or the holding tank, able to simultaneously: rinse and remove debris from, filter and disinfect the mop cleaning head, and move the contaminated water from the rinse tank to the holding tank, and move the re-cycled water from the holding tank to the rinse tank;

a sensor in communication with the cleaning mechanism and configured for determining that the mop cleaning head has been received in the rinse tank receptacle;

a control module configured to direct the cleaning mechanism to clean the mop cleaning head when the cleaning head has been received in the rinse tank receptacle; and, c) wherein the mopping system is able to prevent a user from being exposed to contaminants and pathogens, and/or from being required to exert physical force, in order to rinse and disinfect the mop cleaning head.

2. The touchless, recycling cleaning system of claim 1, wherein the holding tank further comprises a filter cartridge able to pass the contaminated water through the filter to remove small debris before the recycled water is pumped back into the rinse tank.

3. The touchless, recycling cleaning system of claim 1, wherein the holding tank further comprises a disinfectant discharging unit for providing one or more additives to the recycled water in the holding tank, wherein the additives comprise: a deodorant, a sanitizer, a pH balancer, and a cleaner.

4. The touchless, recycling cleaning system of claim 1, wherein the holding tank further comprises a disinfectant discharging unit comprising an ultra-violet irradiated disinfectant assembly able to kill micro-organisms within the recycled water.

5. The touchless, recycling cleaning system of claim 1, wherein the cleaning mechanism further comprises a first pressure-circulating pump module comprising one or more pumps able to circulate the recycled water from the holding tank into the rinse tank, and simultaneously able to supply the re-cycled water under a pressure to at least one spray nozzle assembly positioned within the rinse tank receptacle.

6. The touchless, recycling cleaning system of claim 5, wherein the cleaning mechanism further comprises a second pressure-circulating pump module 16 able to suction off contaminated water from the mop head, and push the contaminated water through a filtering system from the rinse tank and into the holding tank.

7. The touchless, recycling cleaning system of claim 5, wherein the at least one spray nozzle assembly, further comprises, a bar with evenly spaced holes able to release a jet spray to rinse a used cleaning fluids, the contaminated water and a debris from the mop cleaning head.

8. The touchless, recycling cleaning system of claim 6, wherein the cleaning mechanism filtering system comprises a strainer assembly located within a bottom of the rinse tank, and comprising a mesh filter or grille able to remove large debris from the contaminated water in the mop cleaning head when a suction force is applied, prior to the contaminated water being circulated to the holding tank by the second pressure-circulating pump.

9. The touchless, recycling cleaning system of claim 1, wherein the cleaning mechanism comprises a squeeze assembly comprising, a linear actuator, or a rotating crank or screw, able to squeeze fluid from the mop cleaning head by applying a horizontal force to a sides of the mop cleaning head.

10. The touchless, recycling cleaning system of claim 1, wherein the cleaning mechanism comprises a squeeze assembly comprising, a roller able to move front to rear one or more times beneath the mop cleaning head and able to squeeze fluid from and/or apply a conditioner to said head.

11. The touchless, recycling cleaning system of claim 1, wherein the control module is able to direct: a squeezing assembly to squeeze a used cleaning fluids and the contaminated water from the mop cleaning head; and/or a straining assembly to filter large debris from the head; and/or, a jet spray nozzle assembly to spray the mop cleaning head with re-cycled water and cleaning fluid.

12. The touchless, recycling cleaning system of claim 1, further including a pH sensor in the holding tank for monitoring pH of a used cleaning fluids, the control module further configured to direct an alert to the user that the monitored pH is not within a predefined acceptable levels.

13. The touchless, recycling cleaning system of claim 1, wherein the touchless cleaning system further includes one or more roller wheels on a bottom portion thereof, and wherein the rinse tank receptacle is configured to lock the mop cleaning head in place when received such that the touchless cleaning system can be translated across a hard surface floor by a user applying a force to the floor cleaning apparatus tubular member.

14. The touchless, recycling cleaning system of claim 1, further including a display for viewing by a user, and a touch responsive buttons for allowing the user to communicate with the control module.

15. The touchless, recycling cleaning system of claim 14, wherein the display further displays notifications and updates on the system usage.

16. The touchless, recycling cleaning system of claim 1, further including a power source comprising a direct current outlet or a battery unit.

17. The touchless, recycling cleaning system of claim 1, wherein the control module is configurable to direct cleaning of the mop cleaning head via the cleaning mechanism for a predetermined period of time.

18. The touchless, recycling cleaning system of claim 2, further including a sensor configured for determining a usable life of the holding tank filter cartridge, the control module being configured to display an alert to a user when the usable life is not within a predetermined acceptable range.

19. The touchless, recycling cleaning system of claim 1, wherein the mop cleaning head is able to swivel in all directions at various tension levels and lock in place every forty-five degrees.

20. The touchless, recycling cleaning system of claim 1, further comprising a remote control device in communication with the mopping system, and able to allow the user to remotely direct the movement of the mopping system.

21. The touchless, recycling cleaning system of claim 1, further comprising sensors to detect a user's movement, and wherein the control module is able to direct the movement of the mopping system to follow the user.

* * * * *